United States Patent [19]

Leggett et al.

[11] 3,951,082

[45] Apr. 20, 1976

[54] COUNTERCURRENT FLOW AFTERBURNER

[75] Inventors: Ronald L. Leggett, Louisville; Donald E. Presse, Wheatridge; Carl J. Smith, Louisville; Alton R. Teter, Westminster, all of Colo.

[73] Assignee: The United States of America as represented by the United States Energy Research and Development Administration, Washington, D.C.

[22] Filed: Apr. 22, 1975

[21] Appl. No.: 570,981

[52] U.S. Cl. ..... 110/8 A; 23/277 C

[51] Int. Cl.[2] ..... F23G 5/12

[58] Field of Search ..... 23/277 C, 288 F; 110/8 A, 8 R, 8 C

[56] References Cited

UNITED STATES PATENTS

| | | | |
|---|---|---|---|
| 765,534 | 7/1904 | Williams | 23/277 C |
| 3,068,812 | 12/1962 | Hemeon | 110/8 A |
| 3,610,179 | 10/1971 | Shaw, Jr. et al. | 110/8 A |
| 3,680,501 | 8/1972 | Szilagyi et al. | 110/8 A |

*Primary Examiner*—Kenneth W. Sprague
*Attorney, Agent, or Firm*—Dean E. Carlson; Dudley W. King; Ignacio Resendez

[57] ABSTRACT

Afterburner apparatus for receiving from an incinerator products of combustion and distributing them through a domed distributor in counterflow manner throughout a housing, in opposition to a stream of combustible gas.

6 Claims, 4 Drawing Figures

COUNTERCURRENT FLOW AFTERBURNER

BACKGROUND OF INVENTION

The invention relates to an apparatus or afterburner for association with initial combustion means, such as an incinerator or furnace, to treat or further burn combustion products from the initial incinerator.

Waste products formed in gloveboxes in processes which employ plutonium or other radioactive materials may be contaminated with these radioactive materials. It may be desirable to process these contaminated waste products to extract and remove the radioactive fractions therefrom. At the same time, the processing method should be such as to insure the containment of all contaminants.

The processes for recovering such contaminants require that the plutonium be essentially completely recovered, that an incinerator operate at a temperature greater than 800°C so that both volatile carbon and fixed carbon are completely removed from the ash, that an incinerator temperature be at near or not much greater than 800°C to prevent or minimize heating plutonium dioxide to temperatures much greater than this since plutonium dioxide formed at temperatures much greater than 800°C, such as 1,000°C, is dissolved with increasing difficulty as the forming temperature increases, and that incinerator and process components be resistant to hydrochloric acid corrosion since one of the principal products of combustion of the above waste products is hydrochloric acid.

Prior processes and apparatus have disadvantages such that fine carbon carried by combustion gases may not be burned, there is a large amount of soot in the off-gas system, and there is a considerable amount of time and economic loss in replacing filters and maintaining the filtering system. An off-gas system as used herein refers to an exhaust system using a suction fan or the like to pull air into the incinerator to promote combustion and remove heat and combustion products from the system.

SUMMARY OF INVENTION

In view of the above disadvantages, it is an object of this invention to provide an improved afterburner apparatus.

It is a further object of this invention to provide apparatus which, when used in association with a system for removing combustibles from plutonium contaminated waste products, materially reduces the disadvantages of said system.

It is a further object of this invention to provide a countercurrent afterburner apparatus.

Various other objects and advantages will appear from the following description of the invention and the most novel features will be particularly pointed out hereinafter in connection with the appended claims. It will be understood that various changes in the details, layout, and materials as are herein described and illustrated in order to explain the nature of the invention may be made by those skilled in the art without departing from the scope of the invention.

The invention comprises an afterburner apparatus having a housing which generally encloses an afterburner chamber, refractory insulating material liner adjacent the interior of the housing, a passageway interconnecting a conduit exterior to the afterburner and the afterburner chamber for passage of incinerator combustion products, a perforate, dome-like contoured grate disposed over the passageway to uniformly distribute the incinerator combustion products in the chamber, a plurality of openings disposed on a top cover of the afterburner housing for removal of combusted gas, and means for introducing and igniting fuel within the chamber disposed on the top cover for directing the afterburner flame in countercurrent direction to the flow of the incinerator combustion products.

DETAILED DESCRIPTION

Figure 1:
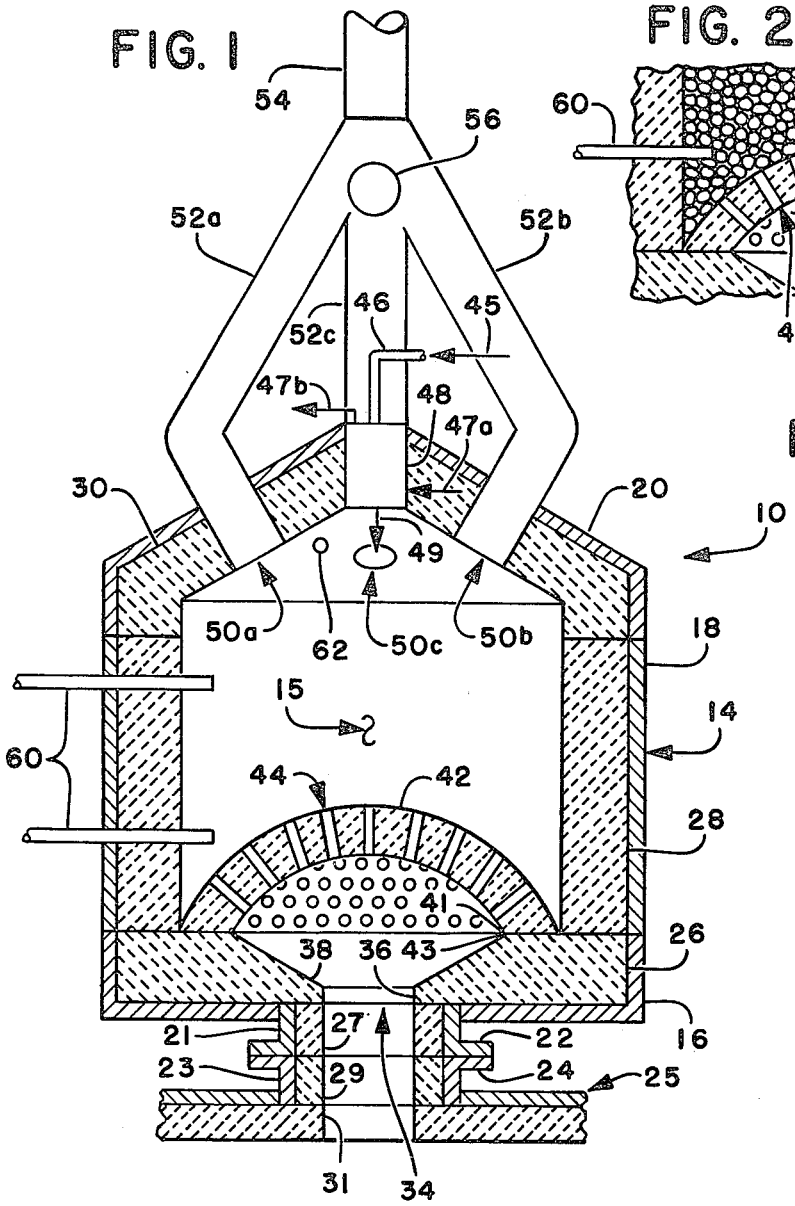
FIG. 1 illustrates in somewhat diagrammatic and cross-sectional fashion a preferred embodiment of the invention.

As shown in FIG. 1, the apparatus 10 may have a metal housing 14 enclosing or forming a chamber 15. The housing may comprise an end wall or bottom portion 16, a hollow, cylindrical intermediate portion 18 and a generally conical top cover or enclosure 20. Appropriate heat insulative refractory material such as prefired or castable aluminum oxide or fireclay having a density approximately 70% of theoretical with good thermal shock resistance and being from about 94 to about 96 percent aluminum oxide for resistance to acid attack as well as to fly ash corrosion may be disposed as a liner adjacent metal housing 14 in sections 26, 28, 30 which correspond with bottom portion 16, hollow cylindrical intermediate portion 18 and top cover 20 respectively. Bottom portion 16 of metal housing 14 and bottom section 26 of the refractory material have an axially spaced and aligned passageway or inlet opening 34 through which the incinerator combustion products are fed into the afterburner chamber 15.

A tubular member 21 may be suitably connected or engaged with bottom wall portion 16 at one end and have an outwardly extending flange portion 22 at the periphery of the opposite end to facilitate engagement to or connection with another conduit member 23 also having a flange portion 24 for passage of combustion products from incinerator 25 through passageway 34 into chamber 15 as described herein. Tubular member 21, conduit member 23 and incinerator 25 may also have refractory heat insulative material portions or liners 27, 29 and 31 respectively, as described hereinabove for liners 26, 28 and 30. Flanges 22 and 24 may be suitably connected, such as with nuts and bolts, as known in the art.

Passageway 34 walls 36 have a flared, beveled or sloping portion 38 which facilitates distribution of incinerator combustion product into afterburner chamber 15. Generally disposed or extending over passageway 34 within chamber 15 and adjacent beveled portion 38 is a contoured or dome-shaped grate 42 also made from an appropriate heat insulative refractory material or fireclay as described above and containing, throughout its area, a plurality of penetrating apertures, openings or perforations 44 extending radially outwardly therethrough which further disperse or aid in uniformly distributing incinerator combustion products into chamber 15. Penetrating apertures 44 may be uniformly dispersed throughout grate 42. In order to avoid a pressure drop that might cause particles to drop out from the flow stream or to prevent plugging, it may be desirable that the diameter or width of the openings 44 be from about three eighths inch to about three quarters inch and preferably about one half inch. The total area of the holes in grate 42 should at least equal or slightly exceed the area of the inlet opening 34. The grate itself has any suitable thickness such as from about 1.75 inches to about 2.0 inches. The thickness of grate 42 may be determined from such considerations as material to be used, the area to be spanned, etc.

The inner periphery or margin 41 of apertured dome or grate 42 may be generally coincident with the flared portion 38 at an outer periphery 43 thereof as illustrated. This coincidence may be desired to create a smooth flow of gases through the distribution holes 44 with no or minimal pressure drop to thus minimize the discharge of solids such as soot.

A jet or nozzle 48 shown located generally centered at the apex of conical top portion 20 may be any type of nozzle appropriate for feeding a suitable fuel into chamber 15 and burning same within the chamber, and may include an igniting means for igniting this fuel. 300% to 400% excess oxygen may be required to efficiently burn soot and other materials. Excess oxygen refers to the percent of oxygen exceeding the stoichiometric amount for the fuel, such as propane, combustion. If only air is used, a much larger chamber is required. An operating temperature of 1000°C to 1100°C may be required to burn tars and waxes. It may be preferred to use a water cooled, oxygen-propane burner since good results have been obtained using this type of fuel and nozzle, but various other jets, nozzles, and the like may be used. Arrow 45 indicates fuel fed into jet or nozzle 48 by means of conduit 46. Arrow 47*a* indicates cooling water input to cool the burner or nozzle 48 and arrow 47*b* indicates removal of cooling water from the burner.

Figure 4:
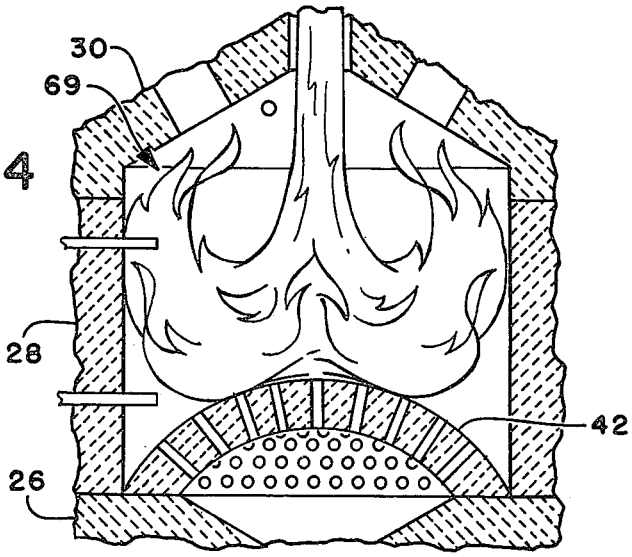
FIG. 4 illustrates in partial diagrammatic and cross-sectional view, a desirable shape of a flame for burning incinerator combustion products in the afterburner of this invention.

The flame ejected from nozzle 48 upon firing thereof is downwardly cast into chamber 15 as indicated by arrow 49, countercurrent to the flow of the incinerator combustion products fed in through opening 34, and may strike grate 42 forming thereby an inverted mushroom-shaped flame as illustrated by inverted mushroom-shaped flame 69 in FIG. 4. This configuration optimizes combustion efficiency of the incinerator combustion products because it uniformly exposes all of the combustion products to the required temperature and oxygen conditions to promote maximum oxidation of carbon and carbon monoxide to carbon dioxide. Also disposed within cover 20 may be a plurality of openings or passageways 50*a*, 50*b*, 50*c* which are equiaxially spaced from cover 20 and refractory section 30. A plurality of conduits 52*a*, 52*b*, 52*c* are disposed over and may form the interior walls of openings 50*a*, 50*b*, 50*c* respectively. These openings preferably may be uniformly distributed, i.e., equidistantly spaced from one another, on the top cover of the afterburner 10 and the combusted or burned soot which was fed into afterburner chamber 24 as an incinerator combustion product is removed from the afterburner by means of these openings and ducts into a main exhaust conduit 54. As illustrated in FIG. 1, the ducts or conduits (52*a*, 52*b*, 52*c*) passing through top cover 20 make an angle of about 90° therewith. This configuration is preferred and results in most efficient removal of burned gases because it prevents severe velocity changes in the gases as they leave the incinerator resulting thereby in a more uniform flame and gas flow pattern as well as a more uniform retention time in the burning chamber.

Opening 56 shown in the drawing leads to a fourth opening in top cover 20. It should be understood that the top portion or cover of the afterburner 10 may contain any number of exhaust ports or openings and these may be distributed uniformly throughout top cover area to provide for better dispersion of particles within the afterburner resulting in uniform temperature and oxygen mixing, thus achieving more efficient operation of the afterburner 10. In order to insure that the flame is operating correctly, and that the correct temperature desired has been attained within the afterburner chamber 15, it may be desired to locate or place one or more thermocouples 60 at various locations through the afterburner wall in afterburner chamber 15. A preferred location may be slightly above the grate 42 to indicate the grate temperature and at an upper portion of the afterburner chamber 15 to indicate the chamber wall temperature. Further, it may be desirable to include a sight port 62, as known in the art, at any desirable location for viewing into the afterburner chamber 15 to verify that the flame has ignited, to observe the flame color as verification of adequate oxygen supply for complete soot combustion, and to observe that the flame shape and distribution is as desired.

Figure 2:
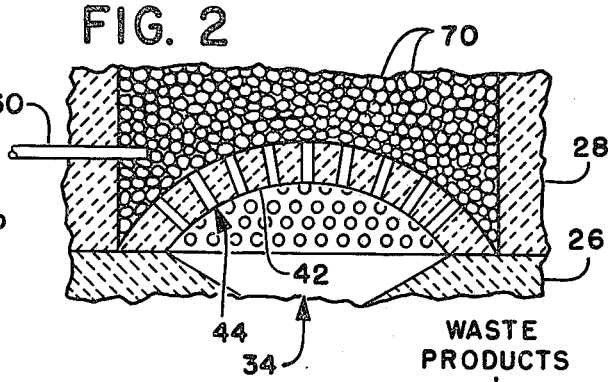
FIG. 2 illustrates in a partial diagrammatic and cross-sectional view a portion of an alternate embodiment of the invention.

As shown in FIG. 2, suitable insulative refractory material 70 may be disposed within chamber 15 in a form such as discrete elements in order to maintain a constant temperature within the chamber and also to create a large contact surface area for burning the carbon soot. Suitable material may be such as aluminum oxide (alumina) spheres, spheroids, pebbles or balls 70.

Figure 3:
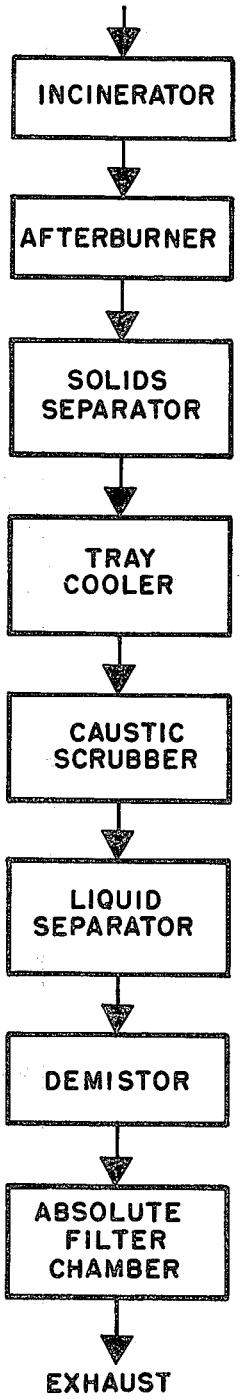
FIG. 3 illustrates a processing sequence for burning plutonium contaminated waste products.

FIG. 3 illustrates a processing sequence. Waste products are introduced into an incinerator in continuous or batch fashion. The size of the charge will be dependent upon the size of the incinerator and the composition of the charge. The incinerator temperature for plutonium containing materials may be such as from about 700°C to about 850°C and preferably about 800°C. In one instance, various waste materials were fed into the incinerator at a rate of 15 grams per minute for 5 minutes (equivalent to about 2 pounds per hour) and burned. The incinerator combustion products passed into the afterburner which was at a temperature of from about 1000°C to about 1100°C. The afterburner combusted gases were then passed into a solid separator to provide for removal of solids from the gases. Soot samples for the data provided hereinbelow were removed from the exhaust conduits at a point between the afterburner and prior to introduction into a solid separator. After passage through the solid separator, the gas is fed into a tray cooler for the purpose of cooling the gases prior to introduction into a caustic scrubber to avoid or minimize evaporation of solution in the caustic scrubber, and is subsequently passed through a caustic scrubber for the purpose of neutralizing acids, such as hydrochloric acid which may be produced during combustion of such as polyvinyl chloride materials. Thereafter, the exhaust gases pass through a liquid separator for removal of liquid from the gases and through a demistor for final liquid separation provided by these two stages of liquid separation.

After passage through the demistor, the gases pass through an absolute filter for removal of particles having a size greater than about 0.3 microns. The gases passing through these absolute filters are of sufficient purity for release into the environment.

Table I illustrates typical waste materials fed into an incinerator. A waste product incineration rate of about 50 pounds per hour produced about 35 pounds of soot per 24-hour day necessitating considerable time and expense for changing filters in the caustic scrubbing unit and in the absolute air filter system, and for disposing of these filters or otherwise recovering the plutonium deposited on the filters.

TABLE I

| Material | Feed (Weight Percent) |
|---|---|
| Polyvinyl Chloride | 39.0 |
| Polyethylene, Polypropylene, Polystyrene | 16.8 |
| Paper | 16.8 |
| Rubber | 4.0 |
| Wood | 7.0 |
| Carbon | 3.0 |
| Graphite | 2.4 |
| Liquids | 5.5 |
| Other Metals | 5.5 |
| Total | 100.0 |

The results in Table II show that neoprene, polyvinyl chloride and latex produced the greatest amount of sooting from the incinerator without the afterburner. When these materials were burned as thin sheets (unfolded), approximately 23 weight percent of the neoprene, 17 weight percent of the polyvinyl chloride, and 11 weight percent of the latex were carried into the off-gas system.

Tests indicate that the afterburner will effectively remove 93% of the soot when polyvinyl chloride comprises 100% of the feed. Only 39 and 49% respectively, of the soot from neoprene and latex could be efficiently removed by the afterburner when these materials comprise the total feed. However, when neoprene and latex were fed at 25% of the normal rate (about 4 grams per minute vs 15 grams per minute), 81 and 69%, respectively, of the soot could be removed by the afterburner. This effect results from the fact that the materials that are burned are thin wall neoprene and latex gloves which instantly release a large volume of combustible gas to the afterburner. As these gases are burned in the afterburner, they expand rapidly and exit the afterburner before the soot becomes completely burned.

TABLE II

| Material | Afterburner in Operation | Percent Excess Oxygen | Weight Feed grams per minute | Average Weight Soot Sample per Five Minutes (grams) | Percent Reduction Soot | Number Samples Taken |
|---|---|---|---|---|---|---|
| Polypropylene | no | — | 15 | 0.0125 | — | 4 |
| | yes | 200 | 15 | 0.0040 | 68 | 2 |
| Polyethylene | no | — | 15 | 0.0194 | — | 6 |
| | yes | 200 | 15 | 0.0067 | 66 | 6 |
| Polyvinyl Chloride (PVC) | no | — | 15 | 0.0960 | — | 2 |
| | yes | 400 | 15 | 0.0062 | 93 | 2 |
| | no | — | 4 | 0.0262 | — | 2 |
| | yes | 200 | 4 | 0.0108 | 59 | 2 |
| | yes | 400 | 4 | 0.0012 | 95 | 2 |
| Neoprene | no | — | 15 | 0.1286 | — | 2 |
| | yes | 100 | 15 | 0.0998 | 20 | 2 |
| | yes | 400 | 15 | 0.0790 | 39 | 2 |
| | no | — | 4 | 0.0336 | — | 2 |
| | yes | 200 | 4 | 0.0091 | 73 | 2 |
| | yes | 400 | 4 | 0.0065 | 81 | 2 |
| Latex | no | — | 15 | 0.0639 | — | 3 |
| | yes | 100 | 15 | 0.0454 | 29 | 2 |
| | yes | 200 | 15 | 0.0368 | 42 | 5 |
| | yes | 400 | 15 | 0.0324 | 49 | 2 |
| | no | — | 4 | 0.0172 | — | 2 |
| | yes | 100 | 4 | 0.0125 | 27 | 2 |
| | yes | 300 | 4 | 0.0057 | 67 | 3 |
| | yes | 400 | 4 | 0.0054 | 69 | 4 |

This sooting problem may be overcome by incorporating a larger afterburner which could provide the required retention time for burning the gases and soot.

The data in Table II obtained from an afterburner which provided an approximately 1.0 second retention time at an exhaust flow of 60 cubic feet per minute indicates that 400% excess oxygen resulted in the most efficient afterburner operation. Little improvement was noted with increased amounts of oxygen.

"Retention time" as used herein refers to the length of time the incinerator combustion products remain in the afterburner prior to being removed. Retention time may vary from about 0.5 to about 1.5 seconds but preferably is from about 0.75 to about 1.0 second.

During the runs from which the data in Table II was obtained, the afterburner was operated with an inside refractory liner surface temperature of from about 950°C to about 1050°C, and a cylindrical intermediate portion 18 temperature of from about 700° to about 800°C. At both lower and higher temperatures, the efficiency of the afterburner may be reduced.

The data of Table II indicates that if waste feed products approximating that normally resulting from production processes is fed at 2 pounds per hour into an incinerator, 4.0 pounds of soot having a volume of 3.2 cubic feet is produced at the end of a 24-hour day. Afterburner removal of soot is about 91%. This results in considerable savings by overcoming the disadvantages of prior processes.

The apparatus of this invention has been incorporated into closed loop systems for processing contaminated or toxic wastes and retaining the radioactive contaminants in the system. "Closed loop" refers to the retention of the radioactive contamination or particles in the system so that these do not pass beyond the absolute filter. What is passed into the atmosphere is such as water vapor, carbon dioxide and excess oxygen. The use of an oxygen-propane fuel to form a flame directed in a countercurrent fashion to the flow of the incinerator combustion products being fed into the afterburner, which incinerator combustion products are uniformly distributed or dispersed by means of aperatures or holes in a grate, has provided efficient burning of the combustibles and minimization of the soot passing into the filtering system.

What is claimed is:

1. Apparatus for treating products of combustion from an incinerator, comprising a housing having an end wall with inlet opening for receiving said products of combustion and an oppositely disposed generally conical end portion, a dome member extending over said inlet opening having throughout its area penetrating apertures for directing said products of combustion toward said end portion and throughout said housing intermediate said dome and end portion, gas supply means carried by said end portion for directing combustible gas toward said dome and throughout said housing intermediate said dome and said end portion, and a plurality of outlet conduits penetrating said end portion for conducting gases and products of combustion from said housing.

2. The apparatus of claim 1 wherein said housing intermediate said dome and said outlet conduit is at least partially filled with a plurality of discrete refractory elements.

3. The apparatus of claim 2 wherein said refractory material comprises aluminum oxide.

4. The apparatus of claim 1 wherein said inlet opening in said end wall has a portion of increasing diameter toward said dome member and the periphery of said dome member adjacent said inlet opening is generally coincident with the periphery of said increased diameter wall portion at the point of contact.

5. The apparatus of claim 1 wherein said dome member has a thickness of from about 1.75 to about 2 inches.

6. The apparatus of claim 1 wherein said plurality of outlet conduits comprises four outlet conduits spaced equidistantly from each other penetrating said end portion.

* * * * *